United States Patent [19]

Dunlap

[11] 4,248,023

[45] Feb. 3, 1981

[54] INSULATED CERAMIC FIBER REFRACTORY MODULE

[75] Inventor: David R. Dunlap, Mexico, Mo.

[73] Assignee: A. P. Green Refractories Co., Mexico, Mo.

[21] Appl. No.: 60,915

[22] Filed: Jul. 26, 1979

[51] Int. Cl.[3] ..... E04B 1/78

[52] U.S. Cl. ..... 52/506; 428/99; 428/300

[58] Field of Search ..... 52/506, 508, 509, 511, 52/513, 597, 270, 404, 410, 415; 428/99, 121, 126, 300

[56] References Cited

U.S. PATENT DOCUMENTS

| | | | |
|---|---|---|---|
| 2,186,223 | 1/1940 | Willetts | 52/415 X |
| 3,378,975 | 4/1968 | Hill | 52/509 X |
| 3,562,987 | 2/1971 | Eakin | 52/506 X |
| 3,738,217 | 6/1973 | Walker | 52/506 X |
| 3,819,468 | 6/1974 | Sauder et al. | 52/270 X |
| 3,832,815 | 9/1974 | Balaz et al. | 52/509 |
| 3,993,237 | 11/1976 | Sauder et al. | 52/745 |
| 4,001,996 | 1/1977 | Byrd | 52/509 |
| 4,123,886 | 11/1978 | Byrd | 52/506 X |
| 4,157,001 | 6/1979 | Pickles | 52/506 |

FOREIGN PATENT DOCUMENTS

| | | | |
|---|---|---|---|
| 950257 | 2/1964 | United Kingdom | 52/509 |

*Primary Examiner*—J. Karl Bell

*Attorney, Agent, or Firm*—Gravely, Lieder & Woodruff

[57] ABSTRACT

This invention relates to a modular insulating article for insulating the interior of a high temperature furnace. The article comprises an outer shell-like form made of a ceramic fiber blanket, and interior layers made of ceramic fiber blanket material. The interior layers are disposed in planes which are parallel to the walls of the furnace. The layers are joined to each other and to the outer shell by means of an anchor pin and/or cement. The module is attached to the furnace wall by a mechanical anchor, preferably a "T" shaped stud, or refractory cement. The module has improved insulating value because of the disposition of the blankets and provides for the use of a high heat resistant blanket near the hot face and of lower cost high insulation blankets adjacent to the furnace wall.

15 Claims, 9 Drawing Figures

FIG. 1
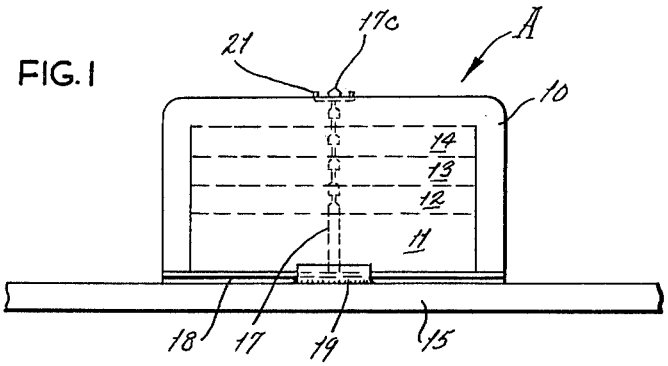
FIG. 2
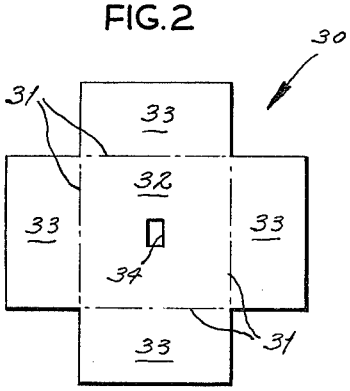
FIG. 4
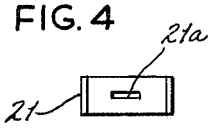
FIG. 3
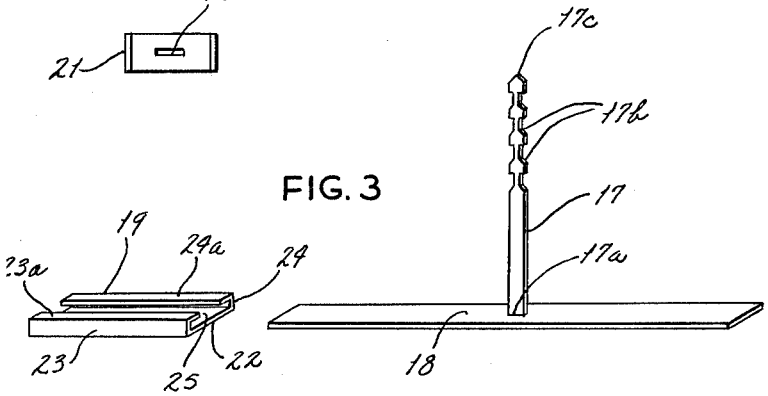
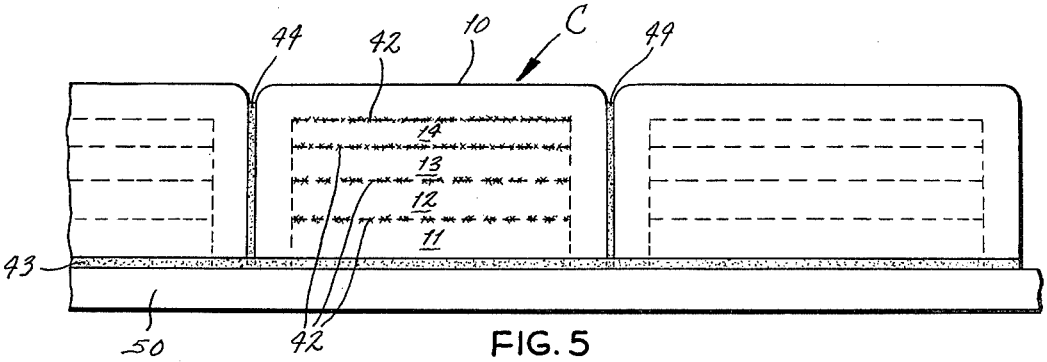
FIG. 5
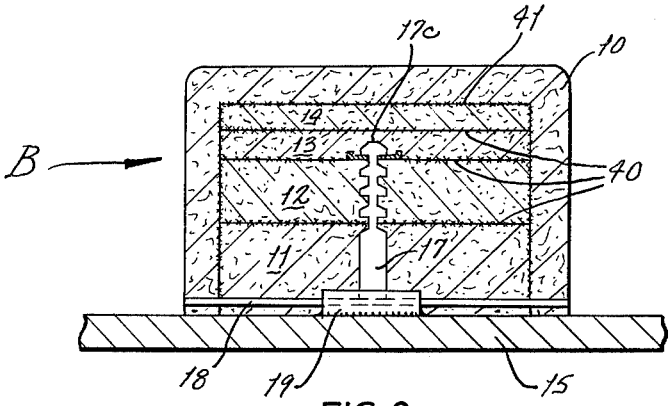
FIG. 6

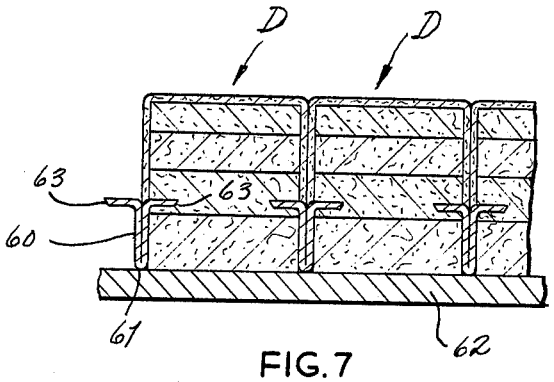
FIG. 7
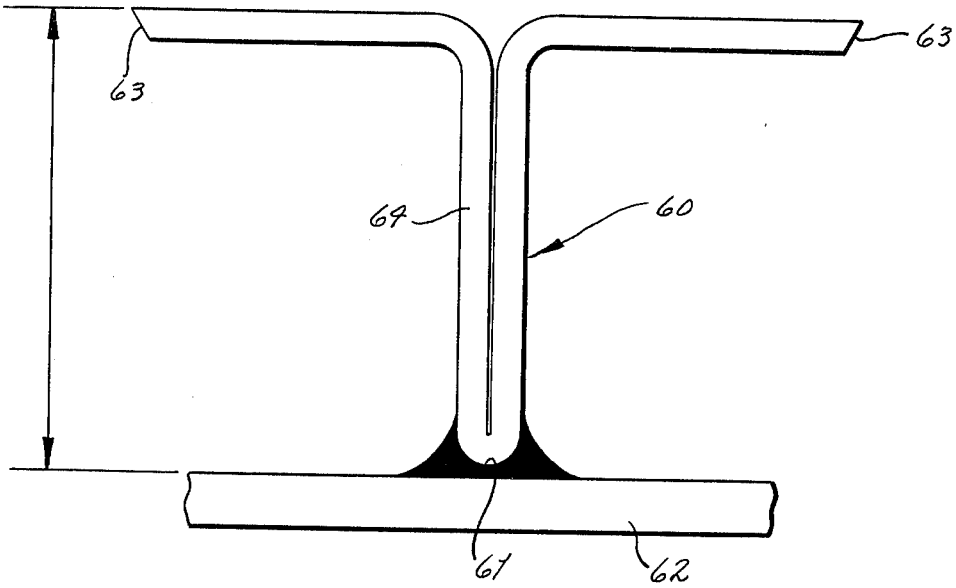
FIG. 8
FIG. 9
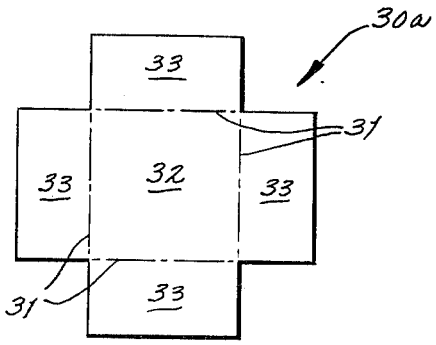

INSULATED CERAMIC FIBER REFRACTORY MODULE

BACKGROUND OF THE INVENTION

The present invention relates to ceramic fiber modules for insulating the interior of a high temperature furnace. In particular, this invention describes a module and method of using the same in which the module comprises a ceramic fiber shell-like form, a plurality of ceramic fiber blankets situated within the shell-like form and means for joining the shell and contents to a furnace housing which generally is of steel.

For many years heat treating furnaces, ceramic kilns, brick kilns, and the like, were lined with dense fireclay brick. Later insulating firebrick replaced the dense fireclay brick because of its lighter weight and better insulating properties. Recently ceramic fiber material made of alumina-silica fibers made into blankets has replaced the insulating firebrick as lining for such furnaces and kilns. The latest advances in this art is the use of module units in which the ceramic fiber blankets are positioned on end, or edge grain, and retained in a blanket which is designed to be attached to the steel frame defining the furnace or kiln.

The rolls of ceramic fibers typically are impaled upon metal studs welded to the furnace walls. This arrangement has several drawbacks, namely that the temperature limit of the construction is dependent on the temperature that the metal studs can stand. Another drawback is that the ceramic fiber blankets are easily damaged, torn and also tend to shrink lengthwise with high temperature use so that gaps are formed between the ends of the blankets.

For economic reasons, it is undesirable to replace a large layered blanket module, which has only a relatively small damaged area. However, unless the blanket is replaced, the damaged area will grow in size.

In order to facilitate replacement of damaged insulation, numerous modular insulation articles have been developed.

The modules eliminate much of the temperature limitation, but there is a possibility that heat can flow between the modules and between the strips of ceramic fibers mounted in the modules. In all of these modules, the blankets are perpendicular to the furnace wall and therefore the thermal conductivity and refractoriness of the module is uniform from hot face to cold face.

Typical of such construction are the Sauder U.S. Pat. Nos. 3,819,468 and 3,993,237. These devices still require a welded stud on the furnace frame and time consuming application. Other patents exemplifying this type construction including Balaz et al U.S. Pat. No. 3,832,815 in which a series of strips of ceramic fibers are clamped together into a module for installation on furnace walls. Still other such devices are shown in Byrd U.S. Pat. Nos. 4,001,996 and 4,123,886.

As mentioned, in all of the foregoing listed patents the fibers in the blanket lie in planes generally perpendicular to the furnace wall. In addition many of these devices require a welded stud on the furnace wall and several of the patents disclose impaling or spearing the ceramic blanket on a pin or stud mounted on the furnace wall with a washter mounted on the end of the stud to hold the blanket in place. These arrangements tend to allow the blanket to sag or tear away from the furnace wall and the stud serves as a conduit for heat from the blanket to the furnace wall.

Accordingly it is a principle object of the present invention to provide a ceramic fiber module in which layers of ceramic fiber blankets are all positioned in a plane parallel to the surface of the furnace wall inside a shell-like form. It is a further object to provide a simple effective means for attaching such ceramic fiber modules to a furnace wall in an efficient and safe manner. It is a further object to provide a method for fastening such ceramic fiber modules to a furnace wall without providing a direct conduit for heat to pass from the furnace to the outside shell.

Still another object is to provide a module of ceramic fiber blankets in which the end of the module closest to the heat of the furnace has a high temperature resistant fiber blanket positioned therein. Closer to the furnace wall are high heat transfer resistance materials.

A still further object is to provide a "T" shaped anchor which is fastened to a furnace frame and retains modules in side-by-side arrangement on the wall while the anchor is protected from direct furnace heat.

These and other objects and advantages will become apparent hereinafter.

SUMMARY OF THE INVENTION

The present invention provides a new and improved composite high temperature and high insulating module of ceramic fibers laid parallel to the wall of the furnace or kiln being lined, and also provides a method for making and using said modules.

DESCRIPTION OF THE DRAWINGS

FIG. 1 is a fragmentary side elevational view partly in detail of one embodiment of this invention;

FIG. 2 is a plan view of the blank from which the shell shown in FIG. 1 is formed;

FIG. 3 is a perspective view of the base and retainer shown in FIG. 1;

FIG. 4 is a plan view of the retainer clip which fits over the end of the base pin in the embodiment shown in FIG. 1;

FIG. 5 is a fragmentary side elevational view partly in detail of another modification of the invention;

FIG. 6 is a fragmentary vertical sectional view of another modification of the invention;

FIG. 7 is a fragmentary vertical sectional view of a preferred embodiment of the invention;

FIG. 8 is an enlarged fragmentary side elevational view of the preferred anchor means shown in FIG. 7; and FIG. 9 is a plan view of a preferred blank for the shell shown in FIGS. 5, 6 and 7.

DETAILED DESCRIPTION

The modular insulating article designated by the letter "A" (FIG. 1) comprises an outer shell-like form 10, insulation layers 11, 12, 13, 14, disposed within the shell 10, an anchor 17, a base 18, and a means 19 for attaching the article to the furnace wall 15.

The outer shell 10 has a rectangular cross section and a depth which varies according to the preference of the user and the thickness and number of the insulating layers 11–14. The depth of the shell 10 preferably is about 6". The configuration of the cross-section is preferably square, and the dimensions preferably 12"×12". The thickness or depth of the shell 10 depends on the temperature of the furnace in which it is located. The higher the operating temperature of the furnace the thicker the module needs to be.

The shell 10 is formed from a blank 30 (FIG. 2) which is cut in the form of a cross. The blank 30 has fold lines 31 to define a closed end 32 and side walls 33. When the side walls 33 are folded inwardly, the shell 10 is formed with an open base. Located within the closed end 32 is an opening 34 which is designed to receive the free end of the anchor 17.

Suitable materials for the shell 10 include commercially available ceramic blankets manufactured under the names Kaowool (Babcock and Wilcox), Fiber-Frax (Carborundum Co.), Lo-Con (Carborundum Co.), Cera-Blanket (Johns Manville Co.) and Cer-Wool (C. E. Refractories). The blankets are made from refractory materials such as chromia-alumina-silica, aluminia-silica compositions, fused silica, high silica glass and zirconia compositions which withstand high temperatures. When erected, the outer shell 10 has the appearance and structure of a five sided box or cube, having a vacant interior portion. Within the vacant interior portion are disposed the insulation layers 11–14. Suitable materials for the layers include the fiber insulating blankets sold under the names Kaowool (Babcock and Wilcox), Fiber-Frax (Carborundum Co.), Lo-Con (Carborundum Co.), Cera-Blanket (Johns Manville Co.), and Cer-Wool (C. E. Refractories). The blankets are made from refractory materials such as chromia-alumina-silica, alumina-silica compositions, fused silica, high silica glass and zirconia compositions which withstand high temperatures.

The thickness of each layer can vary from 1 to about 2 inches and from about $3\#/ft^3$ to about $8\#/ft^3$ in density. It is preferred that the thicker layers be placed closer to the furnace wall and that the thinner layers be placed closer to the "hot face", i.e., the side of the module adjacent to the furnace interior. The quantity of layers to be inserted into the shell varies according to the preference of the user and the operating temperature of the furnace. Also it is preferred that the most highly refractory or high temperature resistant layers be close to the hot face while the less dense and lower cost insulating layers be placed close to the furnace wall. This results in economies of construction and in a more heat resistant and good insulating module. In FIG. 1, the layer 11 has a density of $4\#/ft^3$ while the layer 14 has a density of $8\#/ft^3$. The layer 14 is highly temperature resistant while the layer 11 has excellent resistance to heat transfer, and has a lower cost.

The layers 11–14 are positioned parallel to the furnace wall to provide better insulating effect and also for ease of assembly. When the layers 11–14 are positioned parallel to the furnace wall, it allows the aforementioned variance in density, refractoriness, etc., among the different layers. The layers 11–14 are laid in the shell 10, and the base 18 positioned over the open end of the shell 10.

The insulation layers 11–14 are anchored to each other and to the shell 10 by a suitable adhesive. The modules are attached to the furnace wall 15 by one of several methods or by a combination of these methods.

One method (although not the preferred method) of anchoring the module "A" to the furnace wall 15 is shown in FIG. 1 and involves the use of an anchor pin 17. One end **17*a* of the pin 17 is joined to the base 18 which not only forms the sixth side of the outer shell 10, but also enables the module "A" to be joined to the furnace wall 15**.

The base 18 is rectangular and is made from steel. It is as wide as the width of the module assembly "A" and is as long as the length of the module assembly "A" so that it closes the bottom of said module "A". Any space between modules "A" can be filled with refractory cement or loose fibers.

The anchor pin 17 is essentially an elongated shaft or spindle onto which are impaled the insulating layers 11–14. The pin 17 is formed with spaced serrations **17*b* in order to retain modules of different thicknesses on the furnace frame 15. The anchor pin 17 is fixed to and extends from the base 18 through the outer shell end wall 32. A washer 21 retains the base 18 to the shell 10 and is fastened to the free end 17 of the pin 17. The pin 17 is made of steel and is welded to the base 18. To prevent decomposition from furnace heat and to prevent transfer of furnace heat to the base 18, the pin 17** may be ceramic.

The retainer washer 21 is of an alloy which resists heat and also the effects of the furnace atmosphere. As shown, the retainer 21 is positioned over the last serration of the pin 17 to retain the shell 10 to the base 18. Generally the pin 17 is flat and the retainer 21 has an elongated opening **21*a* which receives the pin 17 and, when rotated, locks the retainer 21 to the pin 17 through the last serration 17*b* adjacent to the pin free end 17*c*. For modules of lesser thickness, the retainer 21 is positioned over a serration 17*b* closer to the base 18**.

The module base 18 to which the anchor pin 17 is attached is preferably made of steel. The base 18 is constructed so that it can be inserted readily into a clip 19 mounted on the furnace wall 15.

The retaining bracket 19 (FIG. 3) preferably is made of cold rolled steel capable of withstanding high temperatures. The bracket 19 has a base 22 which is joined to the furnace wall 15 by welding (FIG. 1) or other suitable means. The bracket 19 has two upstanding legs 23, with internal flanges **23*a*, 24*a*. The flanges 23*a*, 24*a*, the legs 23, 24, and the base 22 form a slide channel 25. To mount the module A in the bracket 19, the module base 18 is inserted into the slide channel 25 and is slid into final position as shown in FIG. 1**.

A modification of the invention is shown in FIG. 6. In this embodiment, the module "B" includes a metal anchor 17 which is shorter than the thickness of the module "B" so that the free end **17*c* is embedded in the body of the insulating layers 11–14. The layers of insulating fiber are held in place by a suitable adhesive (indicated by the numeral 40). The outermost insulating fiber layers 13 and 14 provide additional protection for the metal pin 17 and also reduce the heat transfer from the furnace to the furnace wall 15. In the embodiment shown in FIG. 6, the outer shell 10 also is glued to the insulating layers 11–14 at their edges and is glued to the outermost blanket 14 along the outer surface thereof designated by the numeral 41**.

Still another modification is shown in FIG. 5 and this involves a module C comprising a series of layers of insulating fibers 11–14 bonded together by adhesive 42 between the layers 11–14. This modification usually is cemented in place (using an air setting mortar 43) over existing furnace furnace linings 50. It can be used to repair parts of furnace linings also. It has the advantage of using no metal. The module C has a shell 10 and the shell 10 is adhesively secured to the outermost layer 14 and to the edges of all of the layers. The innermost surface of the innermost layer 11 is secured to the furnace wall 50 or whatever substrate is present on the furnace. Between the modules "C" is refractory mortar 44 which is placed between and around each module C.

The preferred modification is shown in FIGS. 7 and 8 and involves a "T" shaped anchor 60 spot-welded at the free leg of the "T" 61 to the furnace shell 62. The top of the anchor 60 has opposed ends 63 which may be sharpened as shown in FIG. 8. The modules "D" are empaled onto the ends 63 to retain them to the shell 62.

The "T" shaped anchor 60 preferably are of 304SS or 310SS stainless steel and are one piece with the center bar member 64 being bent back on itself so that it is of double thickness. The distance of the top members 63 from the shell 62 is determined by the thickness of the module "D" but preferably is ½ of the height of the module "D".

In the modification shown in FIGS. 7 and 8, the ceramic fiber blanket layers 11, 12, 13, 14 are secured together by any suitable adhesive such as Kaowool Cement by Babcock and Wilcox or Cera-Cote Cement by Johns-Manville. Wherever adhesives are mentioned in this application, any conventional ceramic fiber blanket adhesive is suitable.

FIG. 9 shows a modified shell blanket **30*a* which is usable with the forms of the invention shown in FIGS. 5, 6 and 7 and the modules "B", "C" and "D". It differs from the blanket 30** in that there is no center opening.

Wherever in this specification a module is glued to an existing furnace wall, any commercially available air setting mortar can be used.

The various elements shown in the different embodiments "A", "B", "C" and "D" may be interchanged without affecting the scope of the invention.

What is claimed:

1. An insulating module for lining a wall of a furnace and like equipment comprising:

(a) an outer shell-like form of ceramic fiber insulating material, (b) at least one layer of ceramic fiber insulating material positioned within the outer shell and parallel to the wall to which the module is to be attached, (c) means for joining said shell and layer, and (d) means for attaching the module to the wall.

2. The module of claim 1 where a plurality of ceramic fiber layers are positioned in said shell and the layer closest to the hot face of the module has high temperature resistance.

3. The module of claim 1 wherein the means for attaching the module to the wall penetrates the module from a side intermediate the hot and cold faces.

4. The module of claim 3 wherein the means for attaching the module to the wall is a "T" shaped anchor with the free end of the "T" being weldable to a furnace wall.

5. The module of claim 1 including a base member having a pin joined thereto, which pin penetrates at least one layer of ceramic fiber and including means engaging the pin to lock the module to the base.

6. The module of claim 5 wherein the pin penetrates through the outer surface of the shell and the lock means is secured to the head of the pin and positioned on the outermost surface of the shell to secure the shell and layer to the base.

7. The module of claim 1 wherein the means for securing the shell and layer is adhesive.

8. The module of claim 1 wherein the means for attaching the module to the wall is adhesive.

9. The module of claim 5 wherein the means for attaching the module to the wall are channel-shaped retainers fastened to the wall and provided with channels into which the ends of the base members are releasably positioned.

10. The module of claim 5 wherein the outermost tip of said pin is recessed from the outer shell so as to prevent its damage from the heat of the furnace.

11. A furnace wall comprising side by side rows of the modules of claim 1 positioned on the interior wall of a furnace in adjacent position.

12. The wall of claim 11 wherein a thin layer of refractory mortar is positioned between the modules.

13. The wall of claim 11 wherein the means for attaching the modules to the walls comprise "T"-shaped members secured to the furnace wall and penetrating the side walls of adjacent modules intermediate the hot face and cold face.

14. A refractory module assembly for lining an interior wall of a furnace comprising:

(a) ceramic fiber shells formed into open sided cubes having the open sides disposed adjacent to a wall of the furnace, (b) a plurality of ceramic fiber interior layers positioned within said shells, said layers disposed in planes parallel to the wall of the furnace, (c) bases for said modules, said bases being joined to said outer shells to form the 6th side of the cubes; and (d) "T" shaped refractory anchors, each having one end joined to the furnace wall, said anchors extending into the side walls of adjacent ceramic fiber cubes to anchor the cubes to the furnace wall in side-by-side fixed position.

15. The module assembly of claim 14 wherein the ceramic fiber layers positioned adjacent to the hot faces of the modules are more refractory than the layers positioned adjacent to the furnace wall.

* * * * *